US006167594B1

(12) United States Patent
Steinert

(10) Patent No.: US 6,167,594 B1
(45) Date of Patent: Jan. 2, 2001

(54) SHIFTING DEVICE FOR ESTABLISHING CONTACT BETWEEN A FLAT BAR AND A CLEANER IN A CARDING MACHINE

(75) Inventor: Thomas Steinert, Kempen (DE)

(73) Assignee: Trützschler GmbH & Co., KG, Mönchengladbach (DE)

( * ) Notice: Under 35 U.S.C. 154(b), the term of this patent shall be extended for 0 days.

(21) Appl. No.: 09/409,985

(22) Filed: Sep. 30, 1999

(30) Foreign Application Priority Data

Sep. 30, 1998 (DE) ..... 198 44 789

(51) Int. Cl.[7] ..... D01G 15/76
(52) U.S. Cl. ..... 19/111; 19/102
(58) Field of Search ..... 19/98, 99, 102, 19/103, 104, 107, 108, 109, 110, 111, 115 B, 218, 263; 15/256.53, 256.51

(56) References Cited

U.S. PATENT DOCUMENTS

| | | | | |
|---|---|---|---|---|
| 1,975,741 | | 10/1934 | Clark . | |
| 3,529,326 | * | 9/1970 | Nutter et al. | 19/111 |
| 4,368,561 | * | 1/1983 | Trutzschler | 19/111 |
| 4,759,102 | * | 7/1988 | Verzilli et al. | 19/111 |
| 4,771,514 | * | 9/1988 | Verzilli | 19/109 |
| 4,996,746 | * | 3/1991 | Verzilli et al. | 19/111 |

FOREIGN PATENT DOCUMENTS

| | | |
|---|---|---|
| 29 26 261 | 1/1981 | (DE) . |
| 38 28 581 | 3/1990 | (DE) . |
| 38 34 452 | 4/1990 | (DE) . |
| 297 11 657 U | 10/1997 | (DE) . |
| 180178 | 5/1922 | (GB) . |
| 841363 | 7/1960 | (GB) . |

* cited by examiner

*Primary Examiner*—Michael A. Neas
*Assistant Examiner*—Gary L. Welch
(74) *Attorney, Agent, or Firm*—Venable; Gabor J. Kelemen

(57) ABSTRACT

A carding machine includes a main carding cylinder, a travelling flats assembly having a plurality of flat bars provided with a clothing cooperating with the clothing of the main carding cylinder; an endless flat bar driving element trained about end sprockets and circulating the flat bars in an endless path; a flat cleaning device supported at a location above the flat bar driving element and including a rotatably supported flat brush roller. A shifting device is provided for raising the flat bar driving element and the flat bars situated at the location towards the flat brush roller for establishing a contacting relationship between the flat brush roller and the clothing of the respective flat bars and for lowering the flat bar driving element and the flat bars situated at the location away from the flat brush roller for discontinuing a contacting relationship between the flat brush roller and the clothing of the respective flat bars.

5 Claims, 5 Drawing Sheets

SHIFTING DEVICE FOR ESTABLISHING CONTACT BETWEEN A FLAT BAR AND A CLEANER IN A CARDING MACHINE

CROSS REFERENCE TO RELATED APPLICATION

This application claims the priority of German Application No. 198 44 789.2 filed Sep. 30, 1998, which is incorporated herein by reference.

BACKGROUND OF THE INVENTION

The invention relates to a cleaning device for the travelling flats forming part of a carding machine. The accumulated strip material composed generally of fibers and dirt particles entrained by the travelling flats or by the points of the flat clothings is conventionally removed by a rotary flat brush, while between the flat brush and the travelling flats which are moved by means of at least one endless, circulating drive element, a relative motion towards and away from one another takes place.

In a carding machine having a travelling flats assembly the flat bars are, in the cleaning direction, freed from the "flat bar strip" (trash, nep-containing fibers, short fibers and other impurities) which, during the carding process, is transferred from the main carding cylinder to the clothing of the flat bars. In practice, for performing the cleaning process, a slowly rotating clothed stripping roll is brought into contact with the flat bar clothings and the stripping roll lifts off the flat bar strip or fiber cake from the flat bar clothing and directly or indirectly transfers it to a removing suction stream. The quality of the cleaning depends primarily from the accuracy of the setting of the distance of the cleaning roller (cleaning brush) from the flat bars.

German Offenlegungsschrift (application published without examination) 38 28 581 to which corresponds U.S. Pat. No. 4,996,746, discloses a cleaning device in which the cleaning brush may be movable towards and away from the travelling flats. It is a disadvantage of the conventional cleaning device that the brush drive co-travels with the flat brush which involves a complex technological outlay. It is a further drawback of the known arrangement that an excessively large mass has to be moved with the cleaning brush and its drive.

SUMMARY OF THE INVENTION

It is an object of the invention to provide an improved cleaning device of the above-outlined type from which the discussed disadvantages are eliminated and which, in particular, is structurally simple, permits a reduced movement of masses and makes possible a more accurate setting between the cleaning brush roller and the flat bars.

This object and others to become apparent as the specification progresses, are accomplished by the invention, according to which, briefly stated, the carding machine includes a main carding cylinder, a travelling flats assembly having a plurality of flat bars provided with a clothing cooperating with the clothing of the main carding cylinder; an endless flat bar driving element trained about end sprockets and circulating the flat bars in an endless path; a flat cleaning device supported at a location above the flat bar driving element and including a rotatably supported flat brush roller. A shifting device is provided for raising the flat bar driving element and the flat bars situated at the location towards the flat brush roller for establishing a contacting relationship between the flat brush roller and the clothing of the respective flat bars and for lowering the flat bar driving element and the flat bars situated at the location away from the flat brush roller for discontinuing a contacting relationship between the flat brush roller and the clothing of the respective flat bars.

By providing that the flat bar driving element is, with the flat bars, movable in the direction of the flat brush roller, the drive elements for the flat brush roller as opposed to conventional devices—need not be displaced, so that a significantly simplified structure and operating system may be obtained. It is a further advantage of the invention that with the flat bar driving element, including the flat bars, a significantly lesser mass is moved which also results in a structural simplification and, at the same time, makes possible a more accurate setting of the distance between the cleaning brush roller and the flat bars. The flat bar driving element is preferably a flexible belt which can slightly expand, making the intended local engagement with the cleaning brush roller possible.

The invention has the following additional advantageous features:

The flat brush roller rotates slowly, for example, with an rpm of 4–8.

The flat brush roller is associated with a brush cleaning roller rotated, for example, with an rpm of approximately 1,110 to 1,400.

A setting device is provided for shifting the flat bar driving element, and the setting device has a fine-adjustment screw to set the shifting path between approximately 1–3 mm.

The endless circulating flat bar driving element is a flexible belt.

The brush cleaning roller is stationarily supported.

The flat bars are movable along a shifting path which causes a distance change between the flat brush roller and the flat bars.

The shifting path is not perpendicular to the travelling direction of the flat bars.

The shifting device for the flat bar driving element is disposed in the region of the flat brush roller.

DESCRIPTION OF THE PREFERRED EMBODIMENTS

Figure 1:
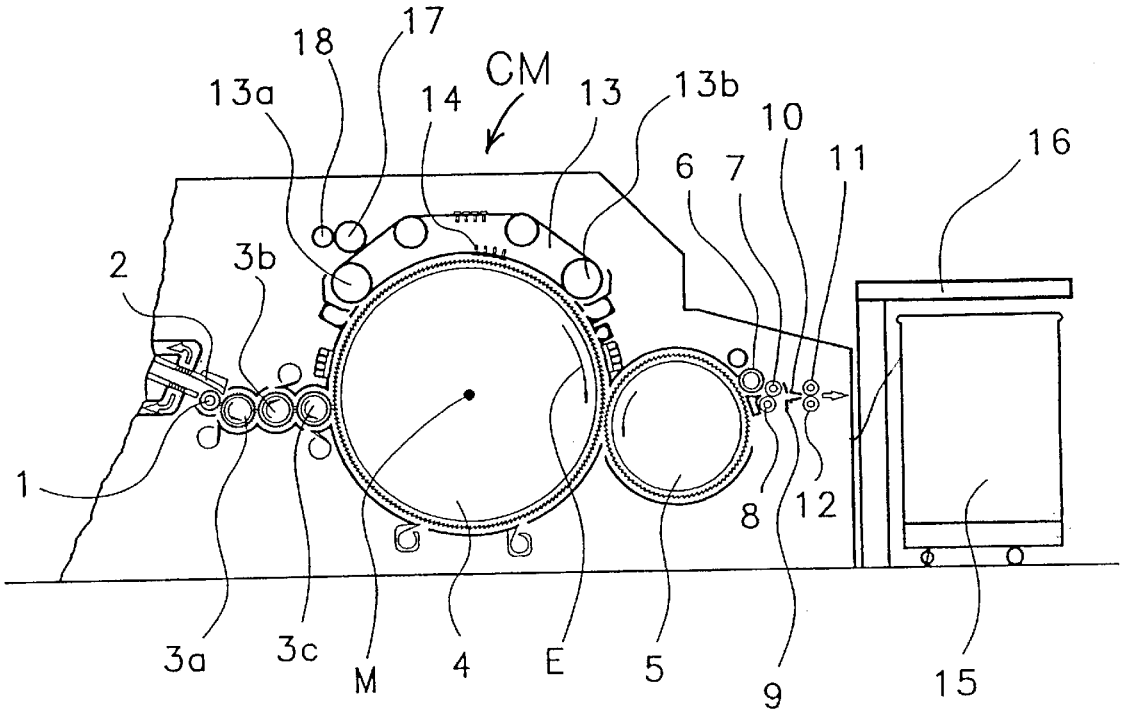
FIG. 1 is a schematic side elevational view of a carding machine incorporating the invention.
Figure 2:
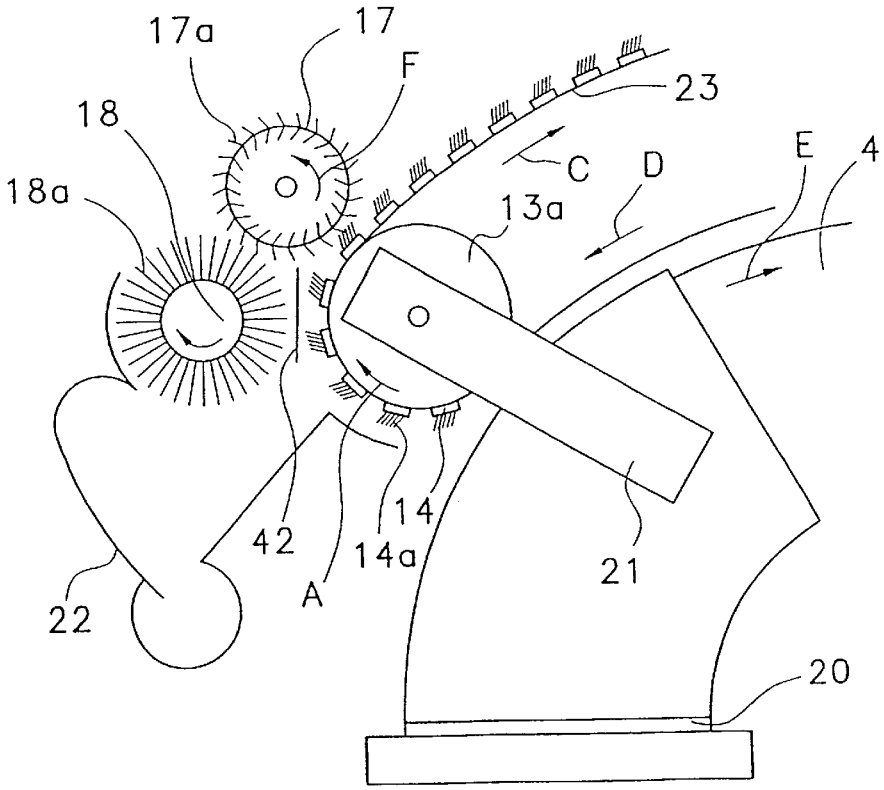
FIG. 2 is a schematic side elevational view of the flat cleaning device including a flat brush roller and a brush cleaning roller in the region of one of the end sprockets of the travelling flats assembly.

Turning to FIGS. 1 and 2, a carding machine CM is shown which may be an EXACTACARD DK 803 model manufactured by Trützschler GmbH & Co. KG, M önchengladbach, Germany. The carding machine CM has a feed roll 1, a feed table 2, licker-ins 3*a*, 3*b*, 3*c*, a main carding cylinder 4, a doffer 5, a stripping roll 6, crushing rolls 7, 8, a web guiding element 9, a sliver trumpet 10, calender rolls 11, 12, a travelling flats assembly 13 having flat bars 14, a coiler can 15 and a sliver coiler 16. The direction of rotation of the various rotary elements is indicated with curved arrows drawn therein. The rotary axis of the carding cylinder 4, rotating in the direction E, is designated at M. The flat bars 14 are drawn over a slide guide by an endless toothed driving belt 23 trained about the end sprockets 13*a* and 13*b*. The end sprockets 13*a* and 13*b* support the belt 23 for positioning the lower flight of the belt 23 adjacent a circumferential portion of the main carding cylinder 4 along a working zone of the flat bars 14 and for positioning an upper flight of the belt 23 above the lower flight along a return zone of the flat bars 14. On the upper side of the travelling flats assembly 13, opposite the slide guide, that is, along the return zone, the flat bars 14 are supported on the top face of returning flight (upper flight) of the toothed belt 23 and travel in the reverse direction as indicated by the arrow C.

With the clothings of the flat bars 14 a slowly rotating flat brush roller 17 is associated whose clothing is in contact with a rapidly rotating brush cleaning roller 18. The end sprocket 13*a* of the travelling flats and the flat brush roller 17 are driven by the output shafts of a joint drive whose input shaft is coupled with a drive motor.

A bracket 21 secured to the frame 20 of the carding machine supports the end sprocket 13*a*. A similar support is provided for the sprocket 13*b* at the opposite end of the travelling flats. The toothed belt 23 is trained about the two end sprockets 13*a* and 13*b* and conventionally entrains the flat bars 14 in an endless path. Removal of the flat strip from the flat bars 14 is effected by the flat brush roller 17 which has a clothing 17*a* formed of small hooks. At a flat bar velocity of, for example, 200 mm/min the flat brush roller 17 has an rpm of 6 (which corresponds to a circumferential speed of 2,564 mm/min for a brush roller diameter of 136 mm). The rotary brush cleaning roller 18 cleans the flat brush roller 17; the brush cleaning roller 18 has a clothing 18*a* situated at a small distance from the clothing of the flat brush roller 17. The brush cleaning roller 18 has an rpm of 1350 (which corresponds to a circumferential speed of 466.5 m/min for a roll diameter of 110 mm). Between the brush cleaning roller 18 and the flat bar clothings 14*a* a guard plate 42 is provided to prevent the dirt from being thrown on or between the flat bars 14. The brush cleaning roller 18 throws the removed dirt into a suction device 22.

Figure 3A:
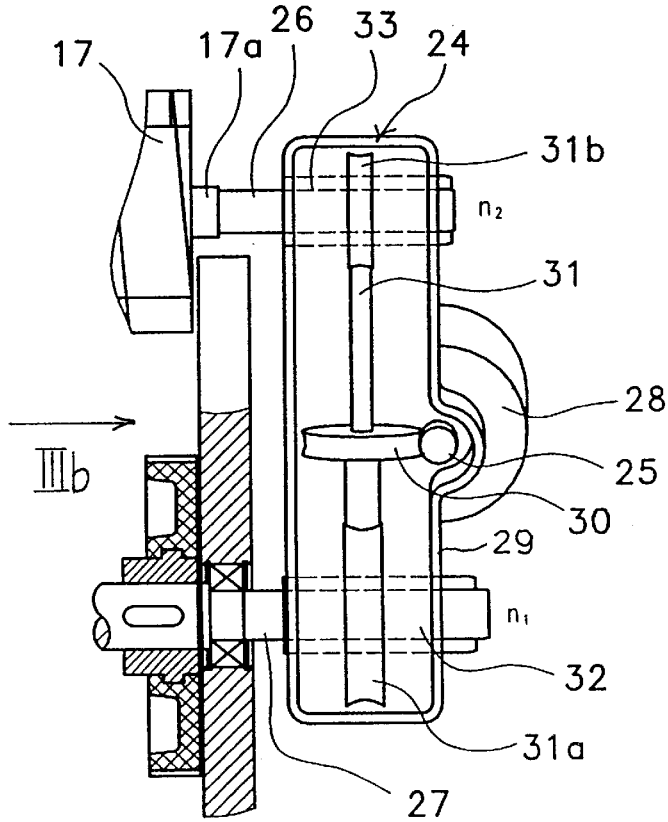
FIG. 3*a* is a schematic front elevational view of an insertable drive with drive motor and two output shafts coupled to an end sprocket of the travelling flats assembly and the flat brush roller.

Turning to FIG. 3*a*, the gearing 24 shown therein has an input shaft 25 and two output shafts 26 and 27. The gearing 24 is enclosed in a housing 29. The input shaft 25 is rotated by an electric motor 28. The output shaft 26 is coupled coaxially to the shaft 17*b* of the flat brush roller 17, while the output shaft 27 is coupled coaxially to the shaft 13*a'* of the end sprocket 13*a*. The distance between the two output shafts 26 and 27 is constant. A portion of the input shaft 25 is formed as a worm gear which meshes with a pinion 30 oriented at 90° to the input shaft 25 and mounted on a shaft 31. The two end portions of the shaft 31 are formed as worm gears 31*a*, 31*b* which cooperate with respective pinions 32 and 33 which, in turn, are mounted on respective output shafts 26 and 27.

Figure 3B:
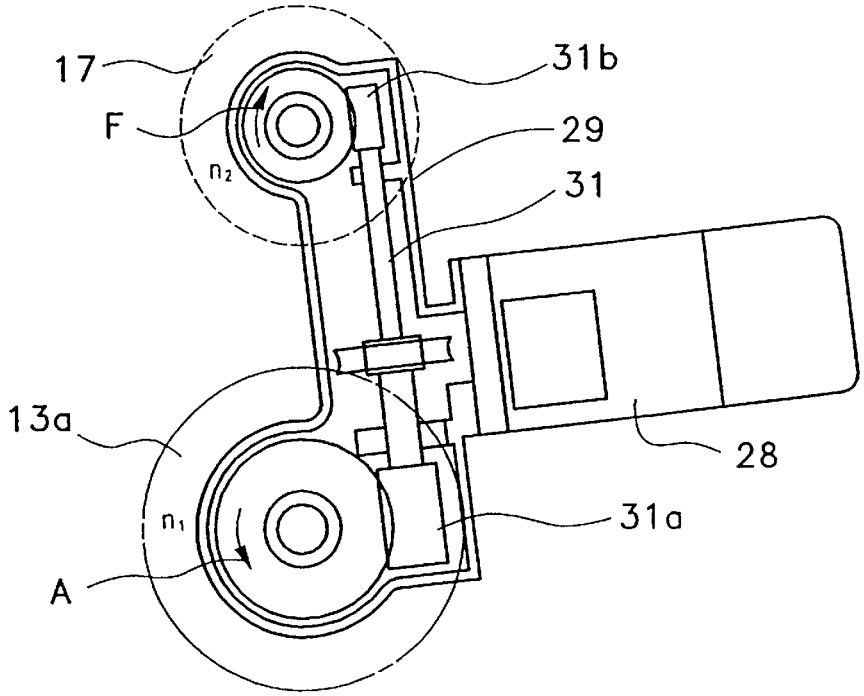
FIG. 3*b* is a side elevational view seen in the direction of the arrow IIIb of FIG. 3*a*.

As shown in FIG. 3*b*, the end sprocket 13*a* rotates in the direction A with an rpm of $n^1$ and the flat brush roller 17 rotates in the direction F with an rpm of $n_2$.

Figure 4:
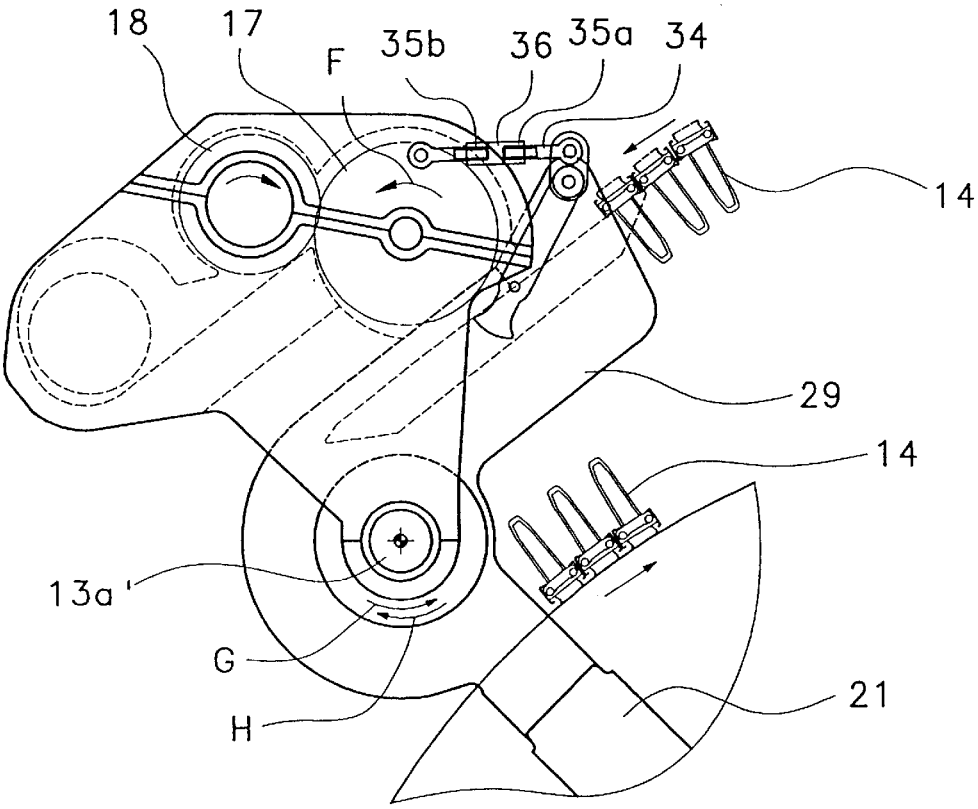
FIG. 4 is a side elevational view of a separate housing for the flat cleaning device, having a rotary axis in alignment with the rotary axis of an end sprocket of the travelling flats assembly.

Referring to FIG. 4, the housing 29 which accommodates the gearing 24, may be turned by a setting device 34 about the shaft 13*a'* of the sprocket 13*a* in the direction of the arrows G and H. The setting device 34 has two oppositely threaded screws 35*a*, 35*b* meshing with inner threads of a turnbuckle 36. The outer end of the screw 35*a* is secured to the machine frame while the outer end of the screw 35*b* is jointed to the housing 29. By rotating the turnbuckle 36 in the one or the other direction, the housing 29 is turned about the axis 13*a'* so that the flat brush roller 17 is moved towards or away from the flat bars 14.

It is noted that the embodiment illustrated in FIG. 4 may also be secured stationarily, that is, without the setting device 34 and without the rotatability of the housing 29 about the axis 13*a'*.

Figure 5:
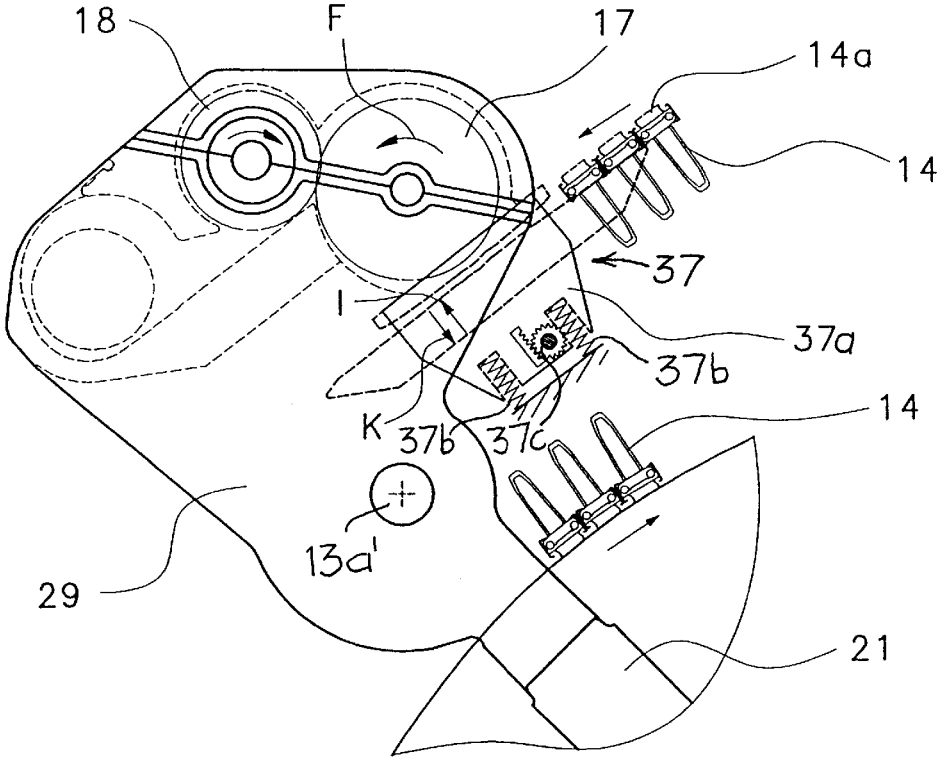
FIG. 5 is a side elevational view of a combined housing for the drives of the flat cleaning device and the travelling flats assembly.

In the construction shown in FIG. 5, the housing 29 and the housing containing the drive for the flat bars are combined into a single, stationarily supported housing. A belt shifting device 37 is arranged on that side of the toothed belt 23 which is oriented away from the flat bars 14 for locally shifting the toothed belt 23, together with the flat bars 14, in the direction of the arrows I, K. The location where such a belt shift takes place is downstream of the sprocket 13*a* as viewed in the direction C of belt travel. The belt shifting device 37 has a block 37*a* which has an upper face situated in the region of the flat brush roller 17 underneath the return flight of the belt 23. The block 37*a* is supported on the machine frame by springs 37*b* and may be raised by a rack-and-pinion drive 37*c* to slightly lift the belt 23 together with those flat bars 14 which, during their travel, are in the region of the belt shifting device 37. Thus, in case the flat brush roller 17 is stationarily (that is, non-shiftably) mounted, the toothed belt 23, together with the flat bars 14 may be lifted for a desired period of time toward the flat brush roller 17 in such a manner that in the region of the flat brush roller 17 the clothing 17*a* of the flat brush roller 17 is in engagement with the dirt strip (not shown) in the flat bar clothing 14*a*.

Figure 6A:
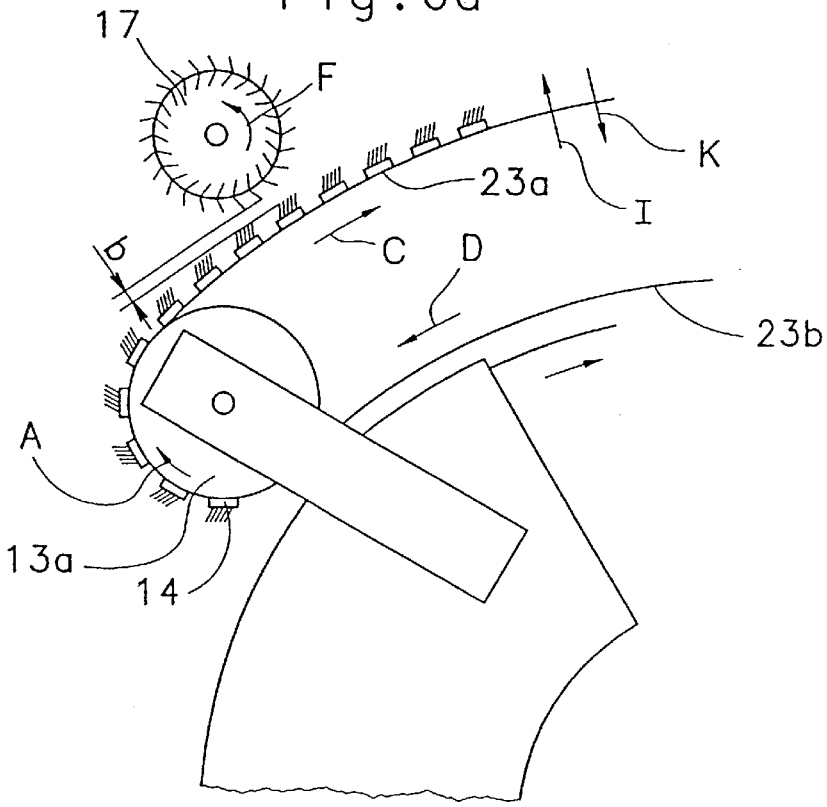
FIG. 6*a* is a side elevational view similar to FIG. 2, showing an embodiment in which the flat brush roller is stationary and the flat bar driving belt is, with the flat bars movable towards and away from the flat brush, wherein the flat brush roller is shown out of engagement with the flat bar clothings.

In FIG. 6*a* between the points of the clothings 17*a* of the stationary flat brush roller 17 and the points of the clothings 14*a* of the flat bars 14 a clearance b is present, that is, the clothings 17*a* and 14*a* are out of engagement with one another. In accordance with FIG. 6*b* the toothed belt 23 with the flat bars 14—as compared to FIG. 6*a*—are shifted in the direction I locally to such an extent that the clothings 14*a* and 17*a* are in engagement with one another. In operation, the flat brush roller 17 rotates in the direction F and the upper flight (return flight) 23*a* of the toothed belt 23 travels in the direction C. As a result, the different circumferential portions of the clothings 17*a* of the flat brush roller 17 engage consecutively the clothing 14*a* of consecutive flat bars 14 and remove the dirt therefrom.

Figure 6B:
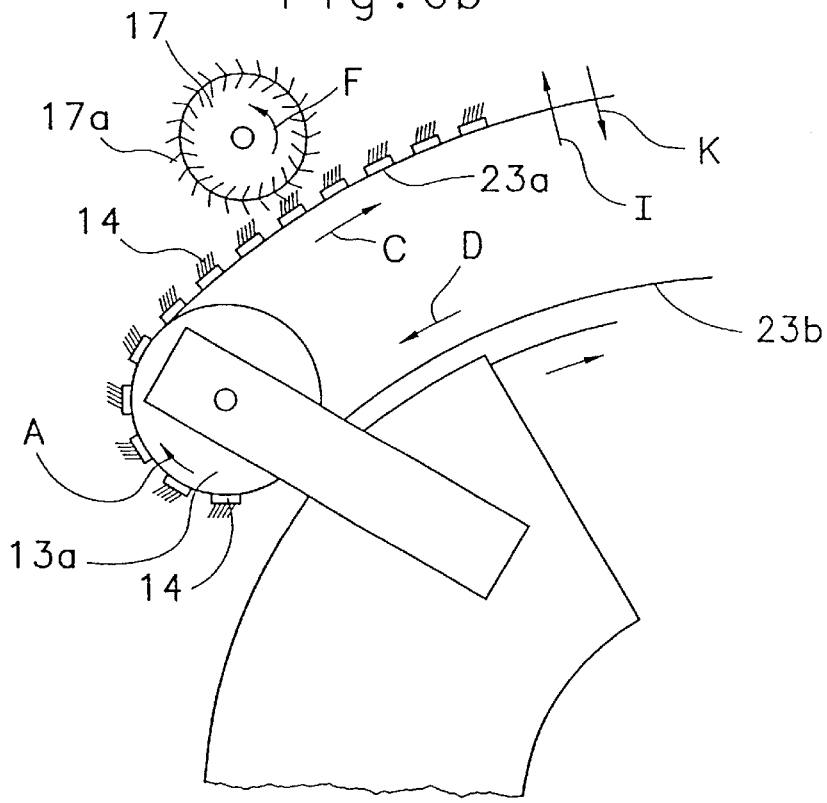
FIG. 6*b* is a view similar to FIG. 6*a*, showing the flat brush roller in engagement with the flat bar clothings.
Figure 7:
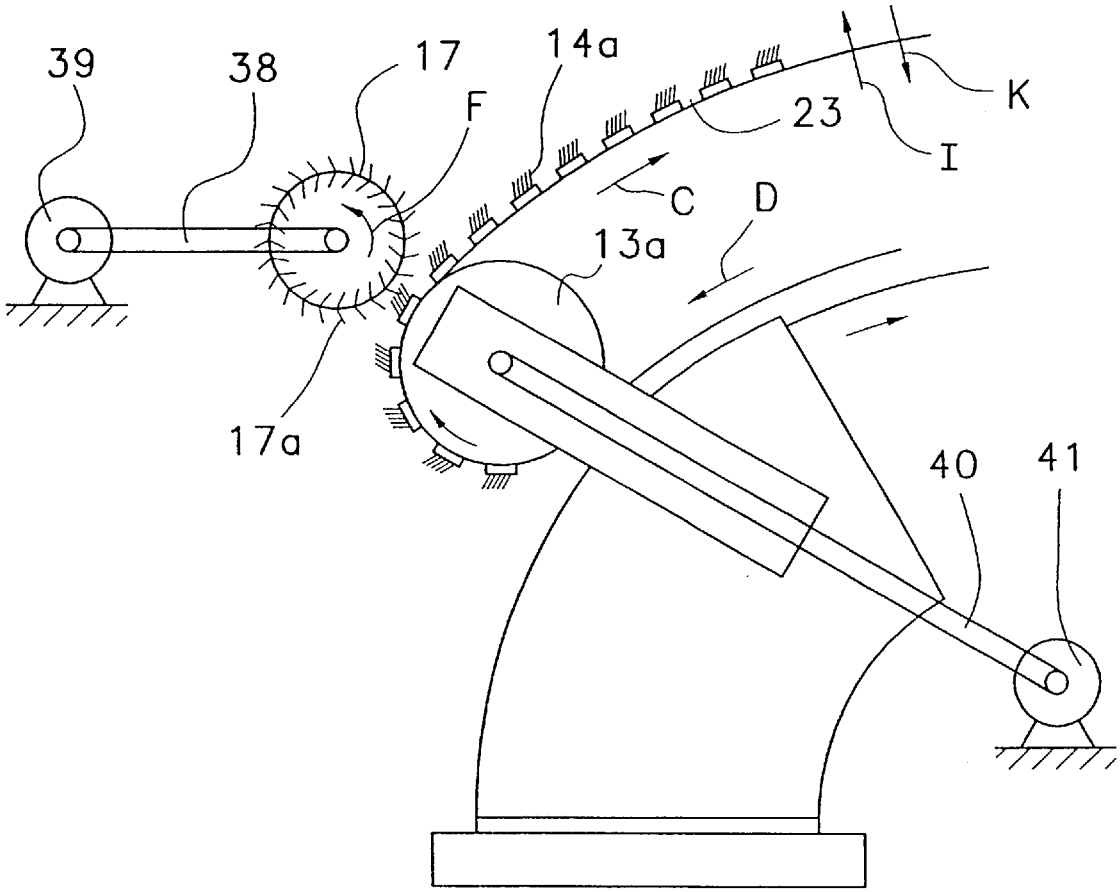
FIG. 7 is a side elevational view of yet another preferred embodiment of the invention, having separate drives for the flat bars and for the flat brush roller.

FIG. 7 shows an embodiment similar to FIGS. 6*a*, 6*b*, that is, there is provided a stationarily supported flat brush roller 17 and a tooth belt 23 which carries the flat bars 14 on their circulating path and which is shiftable in the direction of the arrows I, K. The flat brush roller 17 is driven by a transmission element 38 by an electric motor 39, and the end sprocket 13*a* is driven by a transmission element 40 by the drive motor 41 for the carding cylinder 4 of the carding machine. Thus, in this embodiment two separate drive motors 39 and 41 are provided.

It will be understood that the above description of the present invention is susceptible to various modifications, changes and adaptations, and the same are intended to be comprehended within the meaning and range of equivalents of the appended claims.

What is claimed is:

1. In a carding machine including a main carding cylinder having a clothing;

a travelling flats assembly having a plurality of flat bars having a clothing cooperating with the clothing of the main carding cylinder;

an endless flat bar driving element trained about end sprockets and circulating the flat bars in an endless path;

a flat cleaning device supported at a location above the flat bar driving element and including a rotatably supported flat brush roller; and means for rotating the flat brush roller; the improvement comprising shifting means for raising said flat bar driving element and the flat bars situated at said location towards said flat brush roller for establishing a contacting relationship between the flat brush roller and the clothing of respective said flat bars and for lowering said flat bar driving element and the flat bars situated at said location away from said flat brush roller for discontinuing a contacting relationship between the flat brush roller and the clothing of respective said flat bars.

2. The carding machine as defined in claim 1, wherein said end sprockets support said flat bar driving element for positioning a first flight of said flat bar driving element adjacent a circumferential portion of said carding cylinder along a working zone and for positioning a second flight of said flat bar driving element above said first flight along a return zone; said location being at said return zone for raising a portion of said second flight by said shifting means.

3. The carding machine as defined in claim 1, wherein said shifting means comprises a block member having a surface facing an underside of said flat bar driving element for engaging said underside.

4. The carding machine as defined in claim 3, wherein said shifting means further comprises a raising-and-lowering mechanism for moving said surface into and out of engagement with said underside of said flat bar driving element.

5. The carding machine as defined in claim 4, wherein said raising-and-lowering mechanism comprises a rack-and-pinion drive.

* * * * *